US005703628A

United States Patent [19]

Nishiyama

[11] Patent Number: 5,703,628

[45] Date of Patent: Dec. 30, 1997

[54] IMAGE DATA STORE DEVICE

[75] Inventor: Kiyoharu Nishiyama, Tokyo, Japan

[73] Assignee: Ricoh Company, Ltd., Tokyo, Japan

[21] Appl. No.: 288,716

[22] Filed: Aug. 12, 1994

[30] Foreign Application Priority Data

Aug. 16, 1993 [JP] Japan ..... 5-202314

[51] Int. Cl.[6] ..... G09G 5/00

[52] U.S. Cl. ..... 345/202; 345/203; 395/115

[58] Field of Search ..... 345/185, 192, 345/201, 202, 203, 168, 186, 197, 200; 358/500, 433, 401, 404, 467, 445; 348/448, 449, 500; 395/497.01, 497.02, 497.03, 725, 113–116

[56] References Cited

U.S. PATENT DOCUMENTS

| | | | |
|---|---|---|---|
| 4,001,786 | 1/1977 | Boehm | 395/497.02 |
| 4,766,427 | 8/1988 | Abe et al. | 395/197 |
| 4,780,708 | 10/1988 | Tokumitsu | 345/203 |
| 4,974,097 | 11/1990 | Kaneko et al. | 358/500 |
| 5,014,128 | 5/1991 | Chen | 348/448 |
| 5,027,313 | 6/1991 | Culley | 395/497.03 |
| 5,093,730 | 3/1992 | Ishii et al. | 358/445 |
| 5,159,681 | 10/1992 | Beck et al. | 395/116 |
| 5,170,251 | 12/1992 | Levy | 345/201 |
| 5,220,440 | 6/1993 | Hisatake | 358/433 |
| 5,239,651 | 8/1993 | Sodos | 395/725 |
| 5,250,933 | 10/1993 | Beaudin et al. | 345/185 |
| 5,251,297 | 10/1993 | Takayanagi | 345/203 |
| 5,253,077 | 10/1993 | Hasegawa et al. | 358/401 |
| 5,263,136 | 11/1993 | DeAguiar et al. | 345/201 |
| 5,283,667 | 2/1994 | Kojima et al. | 358/467 |
| 5,440,685 | 8/1995 | Takiyama et al. | 395/169 |

OTHER PUBLICATIONS

"Windows 3.1" special Edition, by Robert Cowart 1992.

*Primary Examiner*—Steven Saras

*Attorney, Agent, or Firm*—Oblon, Spivak, McClelland, Maier & Neustadt, P.C.

[57] ABSTRACT

An image data store device for storing image data in a memory includes a memory gauging unit for gauging an amount of unused space remaining in the memory, a comparison unit for making a comparison of the noted amount with a memory volume needed to store one image in the memory and for providing information on the comparison, and a display unit for displaying the information.

14 Claims, 4 Drawing Sheets

IMAGE DATA STORE DEVICE

BACKGROUND OF THE INVENTION

1. Field of the Invention

The present invention generally relates to image data store devices, and particularly relates to an image data store device used in a video printer for efficiently storing image data.

2. Description of the Prior Art

In video printers commercially available at inexpensive prices for a business use or use in households, an image memory has only enough memory volume for one frame (one page) or less in order to keep costs as low as possible. Thus, the number of images which can be stored in such a device is one, more or less, unless some image compression method is employed.

Methods of storing as large a number of images as possible in a constant memory volume include reducing the sampling number for one image or the number of bits for one pixel and compressing image data by use of DCT (Discrete Cosine Transform) or DCPM (Differential Pulse Coded Modulation). However, the methods listed above cause a degradation in image quality, which is not desirable especially for printed images for an appreciation use.

Image data stored in a non-compressed form takes up too much memory volume, whereas image data stored in a compressed form loses some of its image quality. Thus, it is preferable to be able to select a form in which image data is stored, i.e., a non-compressed form or a compressed form, but this decision on the selection of the form should be dependent on the unused memory volume remaining in the image memory device.

Accordingly, there is a need in the field of image memories for an image data store device which can process image data according to the amount of unused memory space.

SUMMARY OF THE INVENTION

Accordingly, it is a general object of the present invention to provide an image data store device which satisfies the needs described above.

It is another and more specific object of the present invention to provide an image data store device which can gauge the amount of unused memory space and provide information about the noted amount with regard to the size of the image to be stored.

In order to achieve the above objects, an image data store device according to the present invention for storing image data in a memory includes a memory gauging unit for gauging an amount of unused space remaining in the memory, a comparison unit for making a comparison of the noted amount with a memory volume needed to store one image in the memory and for providing information on the comparison, and a display unit for displaying the information. In the image data store device, the memory gauging unit gauges the noted amount by using an address of a current writing location in the memory and a total memory volume of the memory. Thus, the information about the noted amount in comparison with the size of image data can be displayed on the display unit.

It is yet another object of the present invention to provide an image data store device which can display the number of images possible to be stored in the unused memory space by using each image data store mode, and select a form in which image data is stored.

In order to achieve this object, in the image data store device according to the present invention, the comparison unit makes a comparison of the noted amount with a memory volume needed for each of a plurality of predetermined image store modes to store corresponding one image in the memory, and the noted information is numbers, each of which indicates a number of images possible to be stored in the unused space by using a corresponding one of the plurality of predetermined image store modes. Thus, information about the number of images which can be stored in the unused space by using each of the image store modes is displayed on the display device. The image data store device further includes a selecting unit for selecting the image store mode to be used.

Other objects and further features of the present invention will be apparent from the following detailed description when read in conjunction with the accompanying drawings.

DESCRIPTION OF THE PREFERRED EMBODIMENTS

Figure 1:
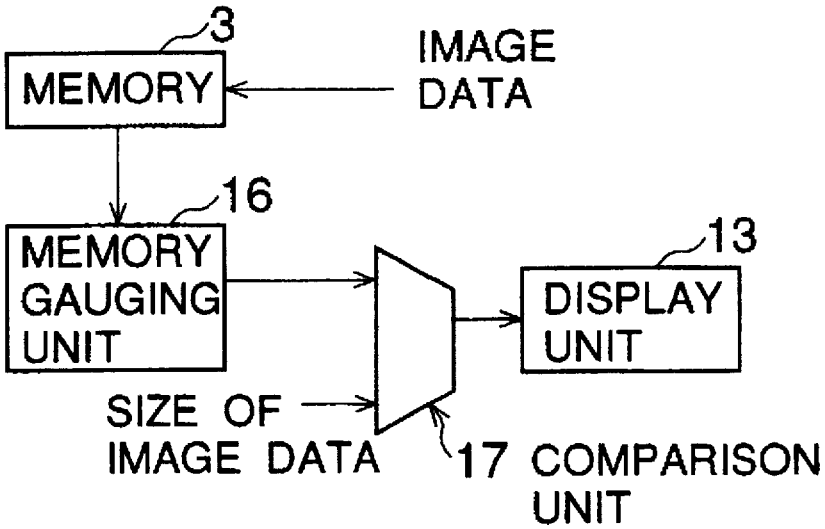
FIG. 1 is a block diagram showing a principle of an image data store device according to the present invention.

First, a description will be given of a principle of the present invention with reference to FIG. 1. FIG. 1 shows a block diagram of the image data store device according to the present invention.

The image data store device for storing image data in a memory 3 includes a memory gauging unit 16 for gauging an amount of unused space remaining in the memory, a comparison unit 17 for making a comparison of the noted amount with a memory volume needed to store one image in the memory 3 and for providing information on the comparison, and a display unit 13 for displaying the information. In the image data store device, the memory gauging unit 16 gauges the noted amount by using an address of a current writing location in the memory 3 and a total memory volume of the memory 3. Thus, the information about the noted amount in comparison with the size of image data can be displayed on the display unit 13.

Furthermore, the comparison unit 17 can make a comparison of the noted amount with a memory volume needed for each of a plurality of predetermined image store modes to store a corresponding one image in the memory 3. In this case, the noted information is numbers, each of which indicates a number of images possible to be stored in the unused space by using a corresponding one of the plurality of predetermined image store modes. Thus, information about the number of images which can be stored in the unused space by using each of the image store modes is displayed on the display device 13.

In the following, an embodiment of the present invention will be described with reference to the accompanying drawing.

Figure 2:
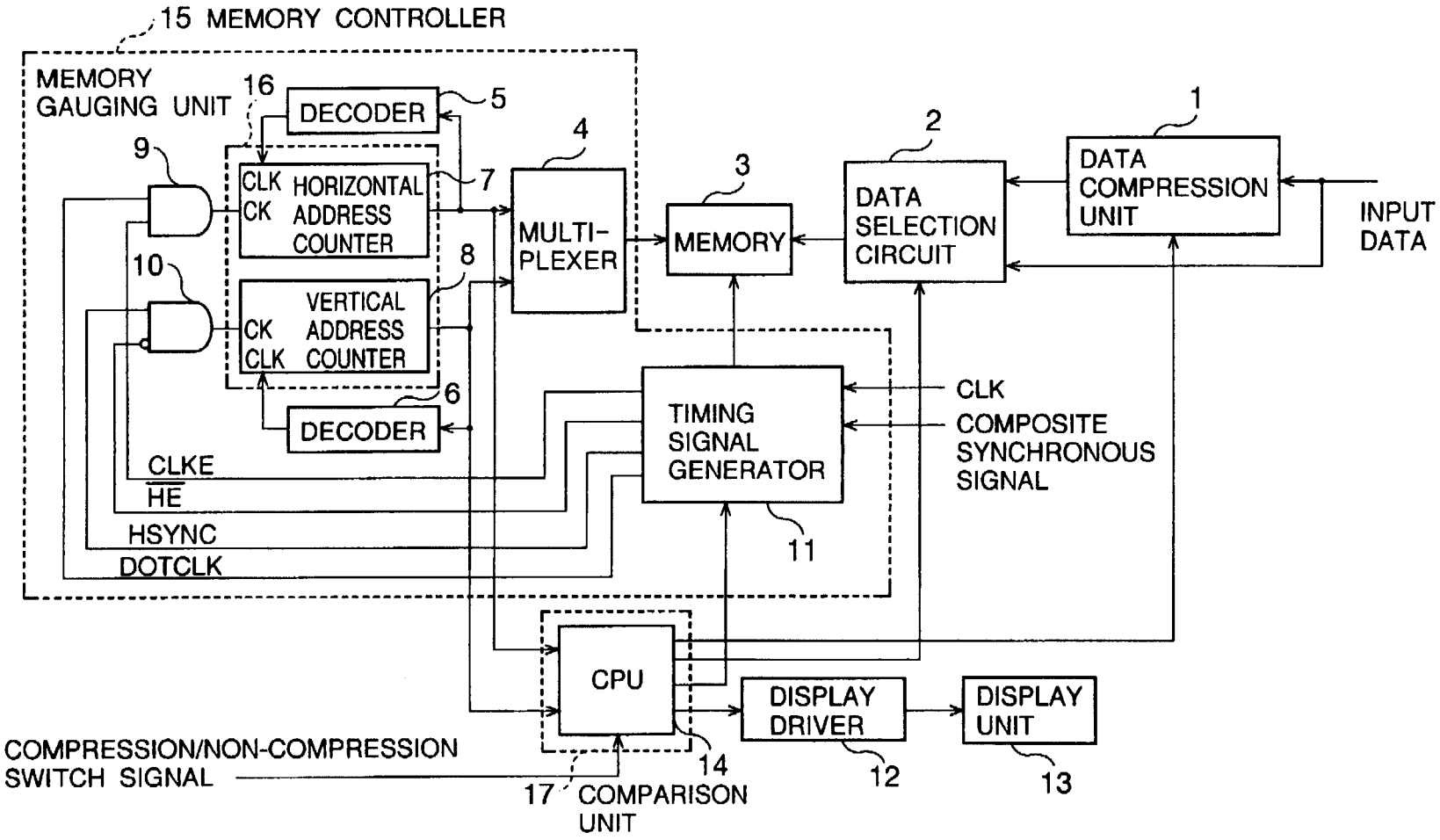
FIG. 2 is a block diagram of a circuit structure of an image data store device according to an embodiment of the present invention.

FIG. 2 is a block diagram of the circuit structure according to the embodiment of the present invention. An image data store device shown in FIG. 2 comprises a data compression unit 1, a data selection circuit 2 for allowing a selection of either a data compression mode or a data non-compression mode, a memory 3 such as DRAM (Dynamic Random Access Memory), a multiplexer 4, decoders 5 and 6, a horizontal address counter 7, a vertical address counter 8, AND gates 9 and 10, a timing signal generator 11, a display driver 12, a display unit 13 comprising a LED (Light Emitting Diode), etc., and a CPU (Central Processing Unit) 14 for controlling the elements listed above.

The data compression unit 1 can transform input data into data of a constant length, and can use such a compression algorithm as ADPCM (Adapted Differential Pulse Coded Modulation) and such data length reduction procedures as reducing a sampling clock rate, decreasing the number of bits representing one digitized value, restricting the area of an image to be stored.

The multiplexer 4, the decoders 5 and 6, the horizontal address counter 7, the vertical address counter 8, the AND gates 9 and 10, and the timing signal generator 11 together comprise a memory controller 15.

The horizontal address counter 7 and the vertical address counter 8 collectively constitute the memory gauging unit 16 for providing information about the amount of unused memory space in the memory 3. The CPU 14 works as the comparison unit 17 for making a comparison of the noted amount with a predetermined amount.

Figure 3:
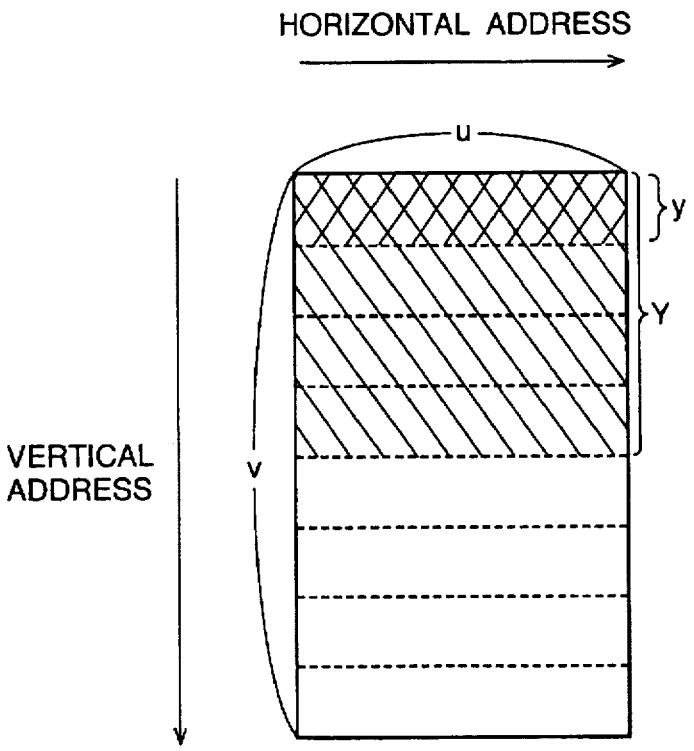
FIG. 3 is an illustrative drawing showing a structure of the memory of FIG. 2.

FIG. 3 is an illustrative drawing showing a structure of the memory 3 of FIG. 2. For the sake of convenience of explanation, the memory 3 can store in one row an equal amount of data to 1H and can store the total of two frames when storing the image in a non-compressed form. When storing an image in a compressed form, one row of the memory 3 can store 1H multiplied by N, with a data compression rate being 1/N (N is a positive integer).

Let the number of columns (the number of addresses in one row) be u, and the number of rows (the number of addresses in one column) v. Also, let the number of rows occupied by one frame be Y in the case of a non-compressed form, and y in the case of a compressed form. In FIG. 3, as can be seen, Y occupies four times as many rows as y, which means that the data compression rate is ¼. Hereinafter, an address in row m and column n is expressed by (m, n).

With data being stored up to row m of the memory 3, the number of frames K which can be stored in the non-compressed form in the remaining unused memory space is the maximum positive integer which satisfies $$K \leqq (v-m)/Y. \tag{1}$$

In the case of the compressed form, the number of frames k able to be stored in the remaining unused memory space is the maximum positive integer which satisfies $$k \leqq (v-m)/y. \tag{2}$$

With reference to FIG. 2 again, the CPU 14 calculate K and k described above based on the results of counting of the used memory space by the horizontal address counter 7 and the vertical address counter 8.

Figure 4:
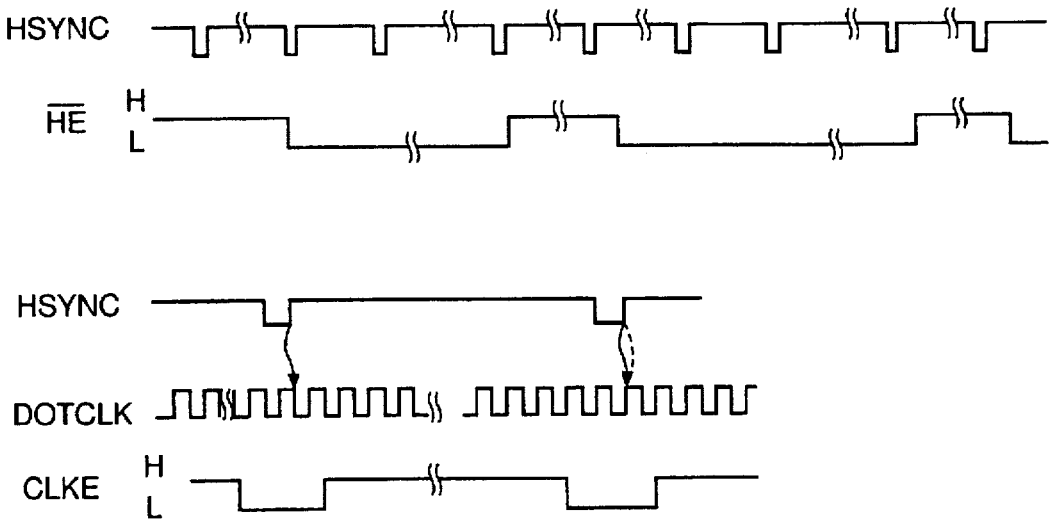
FIG. 4 is a timing chart of each signal of FIG. 2.

With reference to FIG. 2 and FIG. 4, it will be explained below how the horizontal address counter 7 of and the vertical address counter 8 of FIG. 2 keep count of the memory space which has been already used. FIG. 4 shows a time chart of each signal relevant to the counting of the used memory space.

The horizontal address counter 7 counts pulses in a horizontal clock signal (DOTCLK) during the "H" state of a horizontal clock count enable (CLKE), where DOTCLK is a sampling clock for image data. Data is written into the memory 3 during the "H" state of CLKE, and the number of data stored is the number of pulses of DOTCLK during that time. Thus, the output of the horizontal address counter 7 indicates the column number up to which the memory space is occupied by the data. Here, the horizontal address counter 7 is cleared when its output becomes u, i.e., the number of addresses in one row.

The vertical address counter 8 counts the entailing positive edges of pulses in a horizontal synchronous signal HSYNC during the "L" state of a horizontal synchronous signal count enable ($\overline{HE}$). Thus, the number of rows which are occupied in the memory 3 by written data is the number of pulses of the horizontal synchronous signal HSYNC during the "L" state of $\overline{HE}$. In other words, the output of the vertical address counter 8 indicates the row number up to which the memory space is occupied.

Time periods during which $\overline{HE}$ is in the "L" state is controlled by the timing signal generator 11 such that an appropriate count up of the vertical address counter is obtained for a selected compression mode. For example, if a selected compression mode has half the sampling clock rate of the non-compressed mode, $\overline{HE}$ is controlled to make HSYNC pulses pass through the AND gate 10 of FIG. 2 at half the rate of the non-compressed mode. Thus, one row of the memory 3 ends up storing image data for 2Hs if 1H corresponds to one row for the non-compressed mode.

With reference back to FIG. 2, the CPU 14 calculates K and k by using the outputs of the horizontal address counter 7 and the vertical address counter 8. This operation can be carried out by software. The CPU 14 has the values of K and k displayed on the display unit 13 by the use of the display driver 12. Those displayed values of K and k can notify a user of the numbers of frames able to be stored in the memory 3 in a non-compressed form and a compressed form, respectively.

Figure 5:
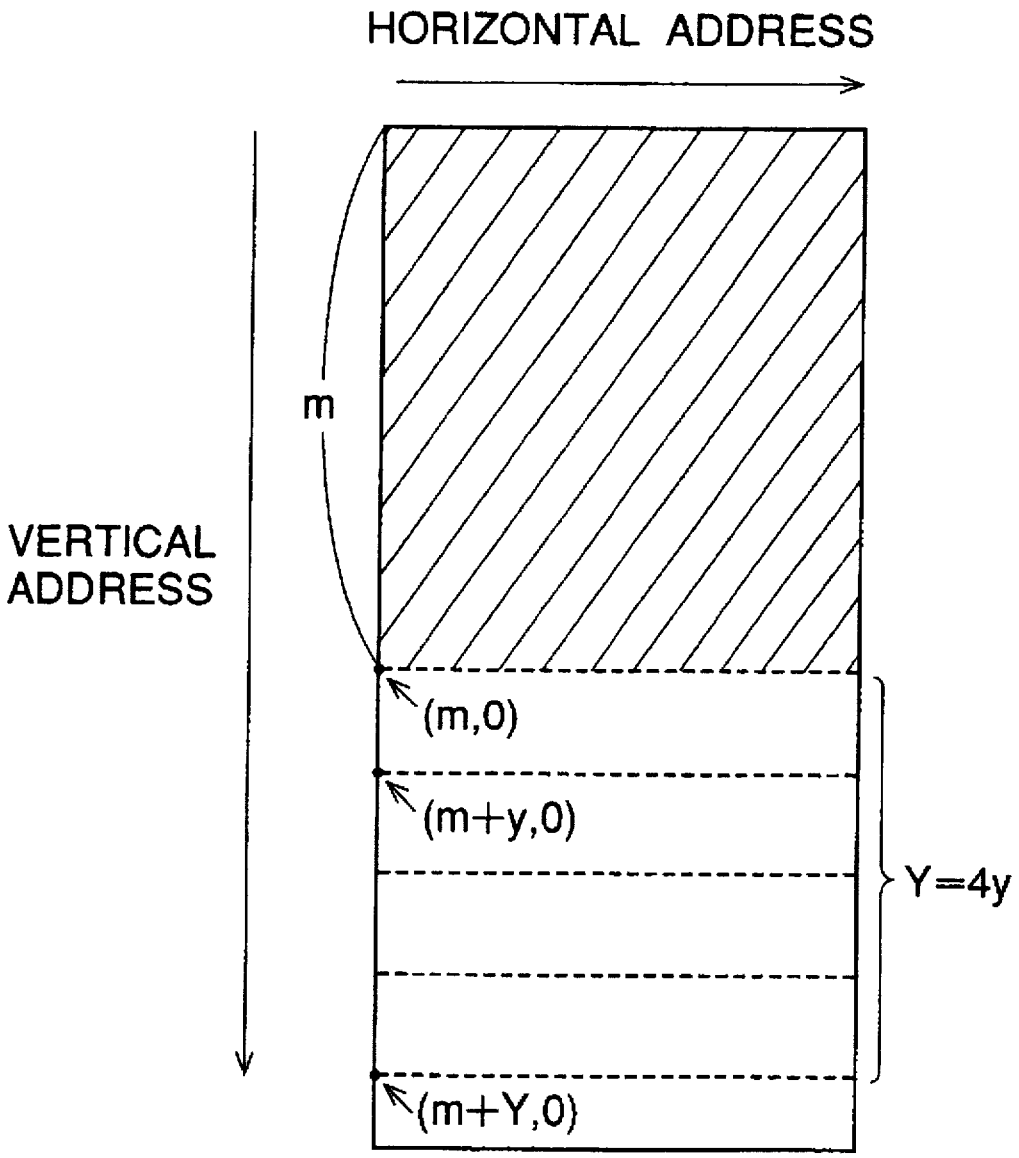
FIG. 5 is an illustrative drawing for explaining the calculation of unused memory space remaining in the memory.

In FIG. 5, assume that data is stored up to row m in the memory 3, K is equal to 1, k is equal to 4, and the image compression rate is ¼. In this case, there is a relationship, $$Y=4\times y \tag{3}$$

between Y and y.

Since both the data compression mode and the data non-compression mode can be used in this case, the user selects a mode with an operation switch (not shown) to send a compression/non-compression switch signal to the CPU 14. Then, the CPU 14 switches a control signal provided for the data selection circuit 2 to set the mode to be used, and notifies the timing signal generator 11 of the start of memory writing. Here, if K is equal to zero and k is greater than zero, the data compression mode is selected automatically. There is not such a case as k is equal to zero and K is greater than zero.

If the data compression mode is selected, data is compressed by the data compression unit 1, and, then, is stored in the memory 3 by the memory controller 15. The data is written into the memory 3 by starting at address (m, 0). When all the data for one frame is stored, the free memory area starts from (m+y, 0).

$\overline{HE}$ and CLKE are in the "H" state and the "L" state, respectively, after the completion of the memory writing, so that the memory address of (m+y, 0) remains unchanged until the next enable pulse is enacted, i.e., a next memory writing process is triggered. The row memory address and the column memory address are provided for the CPU 14, which performs the operations shown in the equation (1) and (2). The results of the operations are K=0 and k=3. As described above, these results are displayed on the display unit 13 controlled by the CPU 14.

If the data non-compression mode is selected, data is stored without compression into the memory 3 by the memory controller 15. The data is written into the memory 3 by starting at address (m, 0). When all the data for one frame is stored, the free memory area starts from (m+Y, 0). At this time, K and k are both zero, which is displayed on the display unit 13.

In the above description, obtaining the volume of free memory space remaining in the memory 3, selecting a mode from the data compression mode and the data non-compression mode, and controlling the display unit 13 for displaying the results are all preformed by the CPU 14 by means of software. However, those operations can be implemented by hardware comprising registers, comparators, decoders, etc.

In the above description, data for 1H of image data just fits into one row of the memory 3 in the case of a non-compression mode. However, even if data for 1H of image data has a different size from that of rows of the memory 3, the same effect as described above can be obtained by using column addresses in addition to row addresses.

As described above, the image data store device according to the present invention can obtain the number of images which can be stored using a particular mode in the remaining unused memory. This can be done by using a known memory volume for storing an image of that mode, the total memory volume, and the current address in the memory so that a required configuration is quite simple. The result can be shown on the display, indicating the numbers of images which can be stored using a data compression mode and a data non-compression mode.

Furthermore, a user of the device can select the data compression mode or the data non-compression mode according to the information provided on the display. Also, the memory controller automatically selects the compression image mode when there is not enough memory space for storing a non-compressed image data, so that making a failed attempt to store too large image data can be avoided.

Further, the present invention is not limited to that embodiment, but various variations and modifications may be made without departing from the scope of the present invention.

What is claimed is:

1. An image data store device, used in a video printer, for receiving, sampling and storing image data in a memory, comprising:

a) memory gauging means for gauging an amount of unused space remaining in said memory based on a sampling clock for sampling said image data;

b) comparison means for (b1) making a comparison of:

1) said amount of said unused space with 2) a memory volume needed to store one image in said memory;

and for (b2) providing information on said comparison; and c) display means for displaying said information on said comparison so as to indicate whether said image data store device can store one image in said memory.

2. The image data store device as claimed in claim 1, wherein:

said display means displays said information when said amount of said unused space is smaller than said memory volume.

3. The image data store device as claimed in claim 1, wherein:

said memory gauging means gauges said amount of said unused space by using an address of a current writing location in said memory and a total memory volume of said memory.

4. The image data store device as claimed in claim 1, wherein:

said comparison means makes a comparison of said amount of said unused space with a memory volume needed for each of a plurality of predetermined image store modes to store corresponding single images in said memory, and said information is numbers, each of which indicates a number of images possible to be stored in said unused space by using corresponding one of said plurality of predetermined image store modes.

5. The image data store device as claimed in claim 4, wherein said memory gauging means gauges said amount by using an address of a current writing location in said memory and a total memory volume of said memory.

6. The image data store device as claimed in claim 5, further comprising selecting means for selecting one of said plurality of predetermined image store modes, so that a user can select one of said plurality of predetermined image store modes by referring to said information.

7. The image data store device as claimed in claim 6, wherein said selecting means automatically selects one of said plurality of predetermined image store modes when said one is the only one possible to be used in consideration of a size of said unused space.

8. The image data store device as claimed in claim 7, wherein said plurality of predetermined image store modes are a non-compression mode and at least one compression mode.

9. An image data store device, used in a video printer, for receiving, sampling and storing image data in a memory, comprising:

a) memory gauging means for gauging an amount of unused space remaining in said memory based on counting pulses in a horizontal clock signal for sampling said image data and pulses in a horizontal synchronous signal;

b) comparison means for (b1) making a comparison of:

1) said amount of said unused space with 2) a memory volume needed to store one image in said memory;

and for (b2) providing information on said comparison; and c) display means for displaying said information on said comparison so as to indicate whether said image data store device can store said one image in said memory.

10. The image data store device as claimed in claim 9, wherein said display means displays said information when said amount is smaller than said memory volume.

11. The image data store device as claimed in claim 9, wherein said comparison means makes a comparison of said amount with a memory volume needed for each of a plurality of predetermined image store modes to store corresponding one image in said memory, and said information is numbers, each of which indicates a number of images possible to be stored in said unused space by using corresponding one of said plurality of predetermined image store modes.

12. The image data store device as claimed in claim 11, further comprising selecting means for selecting one of said plurality of predetermined image store modes, so that a user can select one of said plurality of predetermined image store modes by referring to said information.

13. The image data store device as claimed in claim 12, wherein said selecting means automatically selects one of said plurality of predetermined image store modes when said one is the only one possible to be used in consideration of a size of said unused space.

14. The image data store device as claimed in claim 13, wherein said plurality of predetermined image store modes are a non-compression mode and at least one compression mode.

* * * * *